US005640818A

United States Patent [19]

Wirkus et al.

[11] Patent Number: 5,640,818

[45] Date of Patent: Jun. 24, 1997

[54] BRICK WALLS

[76] Inventors: Randolf Andrew Wirkus; Michelle Ann Wirkus, both of 32 Norm Street, Kenmore, Queensland 4069, Australia

[21] Appl. No.: 542,338

[22] Filed: Oct. 12, 1995

[30] Foreign Application Priority Data

Aug. 15, 1994 [WO] WIPO ..... PCT/AU94/00472
Oct. 12, 1994 [AU] Australia ..... PM8743

[51] Int. Cl.[6] ..... E04B 5/46

[52] U.S. Cl. ..... 52/306; 52/308; 52/245; 52/396.08

[58] Field of Search ..... 52/306, 307, 308, 52/245, 243, 239, 238.1, 745.11, 745.14, 745.05, 591.5, 396.08, 396.1

[56] References Cited

U.S. PATENT DOCUMENTS

| | | | |
|---|---|---|---|
| 2,742,777 | 4/1956 | Corneil et al. | 52/308 |
| 2,780,150 | 2/1957 | Yeoman | 52/591.5 X |
| 4,638,614 | 1/1987 | Wilcox | 52/239 X |
| 4,761,922 | 8/1988 | Black | 52/745.11 X |
| 4,965,975 | 10/1990 | Schwarz | 52/308 |
| 4,986,048 | 1/1991 | McMarlin | 52/306 |
| 5,010,704 | 4/1991 | Thompson | 52/308 |
| 5,031,372 | 7/1991 | McCluer | 52/308 X |
| 5,218,806 | 6/1993 | Taylor | 52/307 X |
| 5,259,161 | 11/1993 | Carter | 52/308 X |

*Primary Examiner*—Carl D. Friedman
*Assistant Examiner*—Winnie Yip
*Attorney, Agent, or Firm*—Fitzpatrick, Cella, Harper & Scinto

[57] ABSTRACT

A glass brick wall assembly 10 comprising a plurality of generally rectangular glass bricks 11 arranged in horizontal runs 12, the wall having horizontally extending elongate separation strips 13 comprising sections 14 connected together by hinge means so that adjacent sections 14 are set at a pivoted position relative to one another.

7 Claims, 6 Drawing Sheets

BRICK WALLS

TECHNICAL FIELD

This invention relates to improvements to brick walls and in particular but not limited to improvements in and in relation to glass brick wall assemblies.

BACKGROUND OF THE INVENTION

Glass brick walls are made using separation strips to frame runs of glass bricks. Present methods do not easily and simple enable the construction of non-straight glass brick walls.

OBJECTS OF THE INVENTION

It is an object of the present invention to provide a method by which glass brick walls of non-straight shape can be easily and economically formed.

SUMMARY OF THE INVENTION

In one aspect, the present invention resides in a brick wall assembly comprising a plurality of bricks laid in runs, the wall having elongated separation strips extending between adjacent runs of bricks, the separations strips comprising adjacent sections connected together and moveable relative to one another so that adjacent sections can be moved to a pivoted position relative to one another thereby forming a non-straight brick wall. Preferably the sections are connected together by hinge means.

In another aspect, the present invention resides in a separation strip for use between runs of bricks in a brick wall, the strip having marginal edge portions and a longitudinally extending intermediate section displaced laterally along the longitudinal line of the strip. This lateral displacement allows adjacent strip sections to be made from a single extruded profile and cut to length thereby forming the sections, alternate sections in the wall are inverted relative to one another to form the hinge means and due to the lateral displacement other parts of the strips remain in-line. Typically, the intermediate section is centrally placed with back-to-back channel sections on either side of the intermediate sections, the back-to-back channel section being adapted to receive and hold jointing paste.

Preferably, the separation strip is of thin sheet material marginally narrower than the width of a side wall of a brick, the strip having relatively thick marginal edge portions and the intermediate section and/or the back-to-back channels being separated by a relatively thin shared wall so as to minimise the amount of material used in the separation strip without compromising strength.

The hinge means is typically formed by inverting one strip and overlaying longitudinally projecting portions of intermediate sections of adjacent separation strips and locating a hinge pin extending between the overlaid intermediate sections thereby securing the sections together so that they can pivot one relative to another.

The bricks are preferably located within a surrounding framework including spaced vertical members, the vertical members having vertically spaced horizontal slots receiving a separation strip section, the section having a transverse shoulder and there being provided a bracket secured to the frame member and engaging the shoulder on the strip section.

In an alternative embodiment the separate strip is supported on a bracket slidably receiving a marginal end portion of a separation strip.

BRIEF DESCRIPTION OF THE DRAWINGS

In order that the invention can be more readily understood and be put into practical effect, reference will now be made to the accompanying drawings which illustrate a preferred embodiment of the present invention and wherein.

DESCRIPTION OF PREFERRED EMBODIMENT

Figure 1:
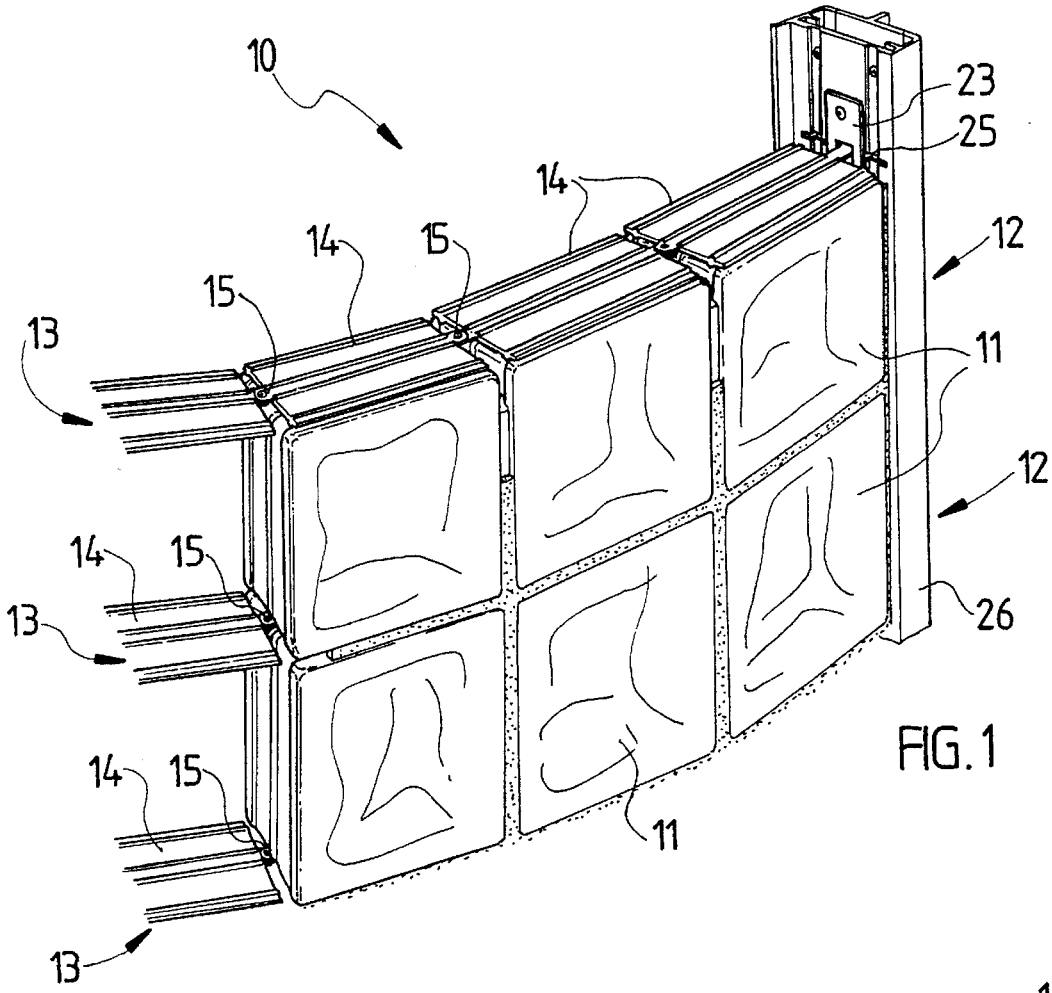
FIG. 1 is a perspective view illustrating one embodiment of the present invention.
Figure 2:
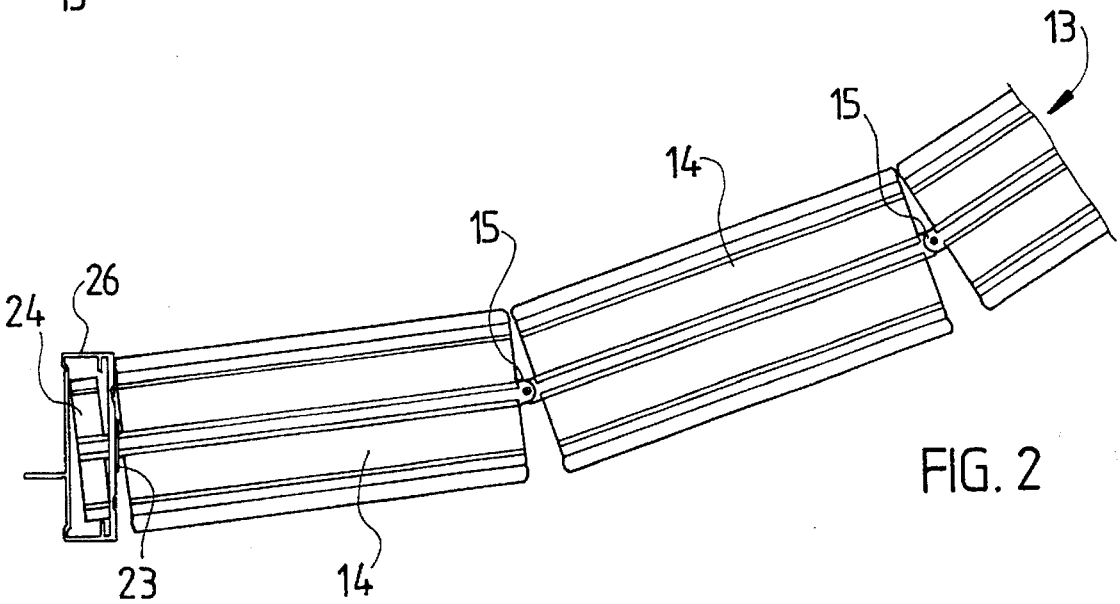
FIG. 2 is a plan view illustrating typical separation strips arranged according to the teachings of the present invention.

Referring to the drawings and initially to FIGS. 1 and 2, there is illustrated a glass brick wall assembly 10 comprising a plurality of generally rectangular glass bricks 11 arranged in horizontal runs 12, the wall having horizontally extending elongate separation strips 13 comprising sections 14 connected together by hinge means so that adjacent sections 14 are set at a pivoted position relative to one another. In the illustrated embodiment, the sections 14 are pivoted so that the glass brick wall 10 has a generally curved shape.

Figure 3:
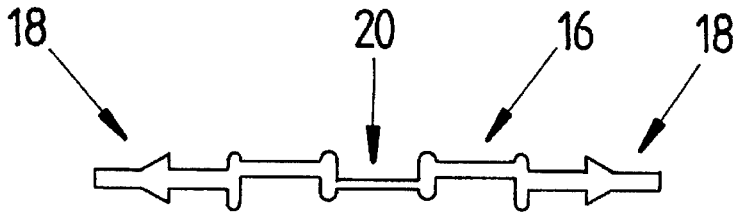
FIGS. 3 and 4 are sections through typical separation strips according to the present invention.
Figure 4:
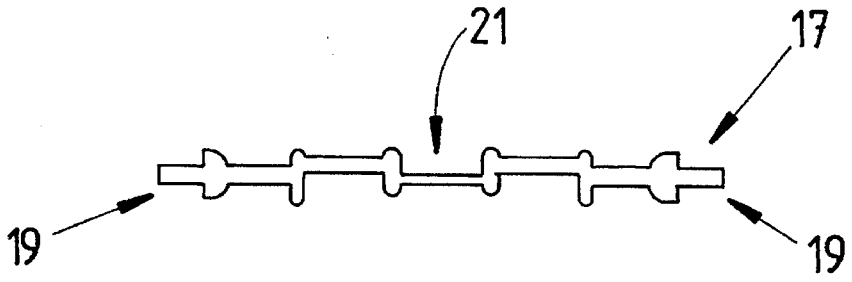
Figure 5:
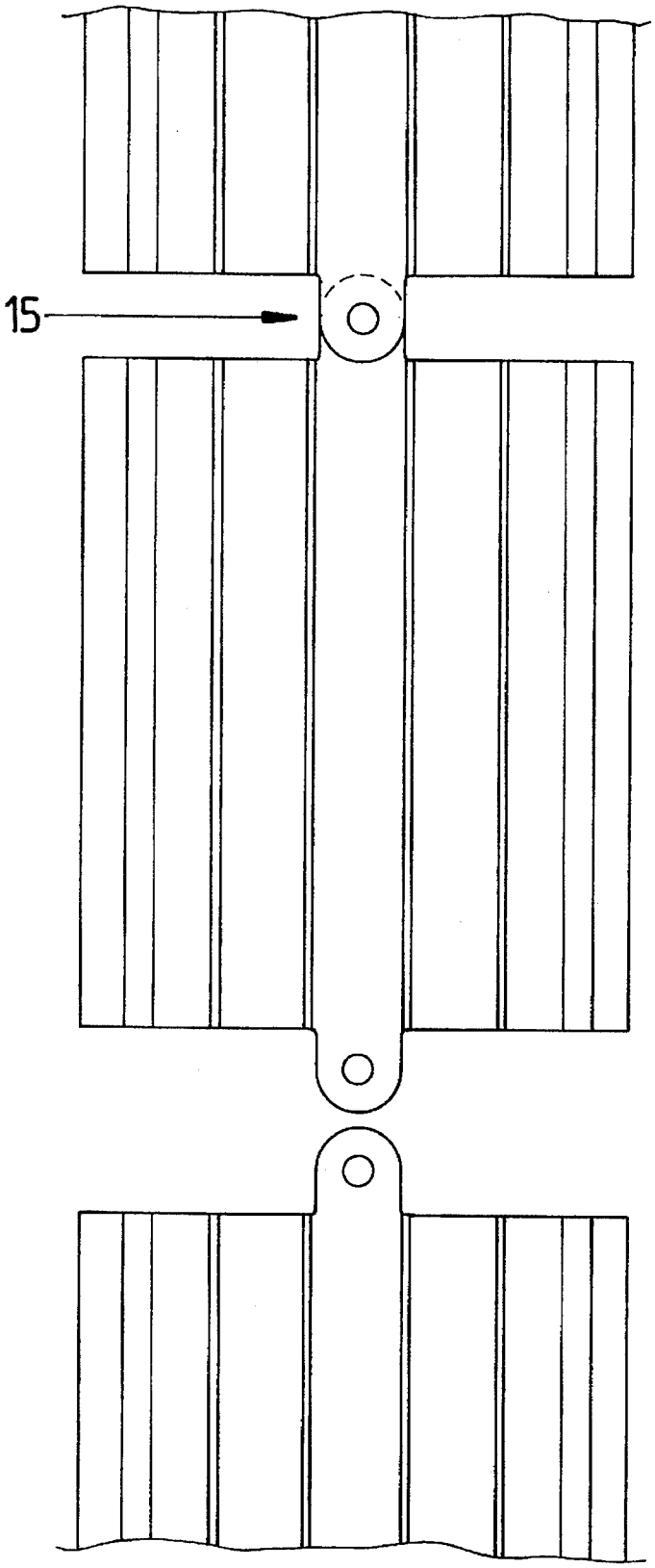
FIGS. 5 and 6 are respective side and plan views showing an arrangement of hinged separation strip sections according to the teachings of the present invention.
Figure 6:
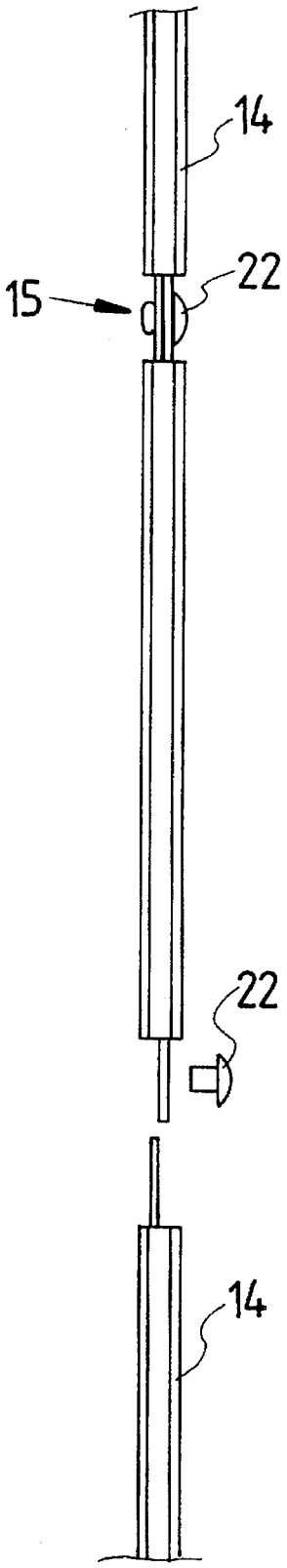

Referring now to FIGS. 3 and 4, there is illustrated two embodiments of separation strips suitable for use in the present invention, the separation strip 16 being suited to particular forms of glass bricks available on the market, whereas the separation strip 17 is designed for other forms of glass bricks available on the market. The separation strips 16 and 17 are typically made from aluminium and are extruded. Each separation strip includes marginal edge portions 18 and 19 respectively and an intermediate section 20 and 21 which is displaced laterally relative to the longitudinal line of the strip so that sections 14 can be cut from the strip and hinged together as illustrated in FIGS. 5 and 6. Alternate sections 14 are reversed so that the protruding portions of intermediate sections 20 and 21 can be arranged to overlap as shown in FIGS. 5 and 6 by virtue of the intermediate sections 20 and 21 being displaced laterally. A fastener 22 can be employed to provide a hinge pin for the hinges 15 so formed.

Figure 7:
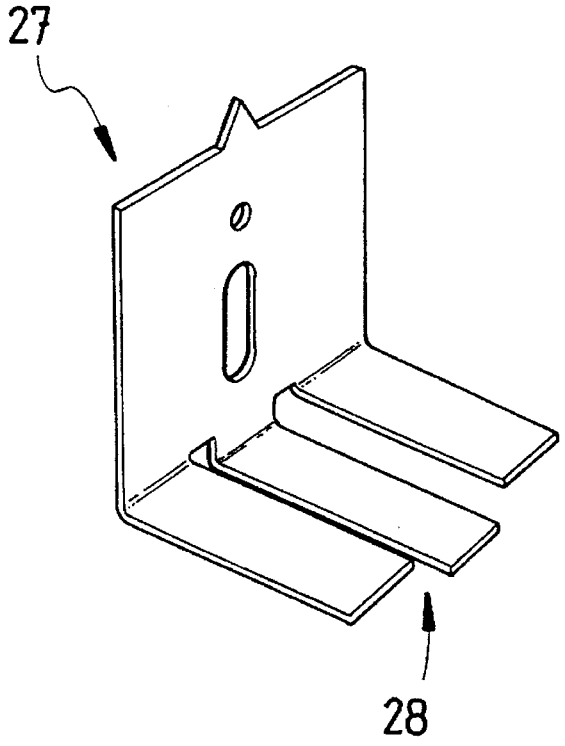
FIG. 7 is an alternative fixing for securing ends of separation strips of the type illustrated in FIGS. 3 and 4.

In the illustrated embodiment of FIG. 1, a U-shaped bracket 23 locks the end 24 of the separation strip in place in a horizontal slot 25 in vertical frame member 26. As an alternative to this and where a frame member 26 is not employed, the metal bracket 27 of FIG. 7 is employed, this bracket can be nailed or otherwise secured to, say, a timber frame and the prongs 28 can locate in the channel sections of the strips illustrated in FIGS. 3 and 4 to thereby support the strips in place in a horizontal attitude.

Figure 8:
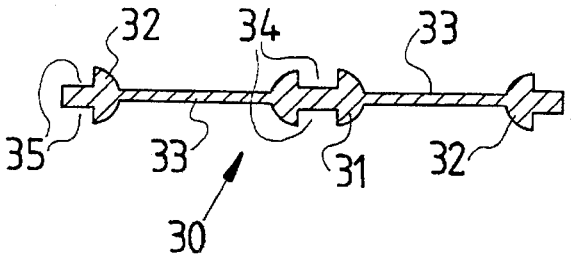
FIGS. 8 to 10 illustrate a further embodiment of the present invention.

Referring to FIG. 8, there is illustrated a sectional view of another preferred embodiment of a separation strip in the form of an extruded aluminium separation strip 30. In this embodiment, the extruded aluminium strip 30 is manufactured in the extrusion process with a central, side and connecting portions 31, 32 and 33 respectively.

In FIG. 8, the central portion 31 has been extruded with back-to-back narrow channels 34 so that the adhesives and/or grouting can be inserted effectively and with great accuracy in the construction process of the glass brick wall.

Similarly, the side portions 32 are extruded with recessed marginal edge portions 35 on both side edges of the separation strip 30 to allow the efficient and accurate insertion of adhesives and/or grouting in the construction process of the glass brick wall.

Additional channels are provided by a shared wall 33 between the central and side portions 31 and 32, the wall 33 being extruded having a narrower gauge of aluminium so that the quantity of aluminium used in the extrusion process is kept to a minimum. The shared wall of channels 34 is thicker to maintain strength.

Figure 9:
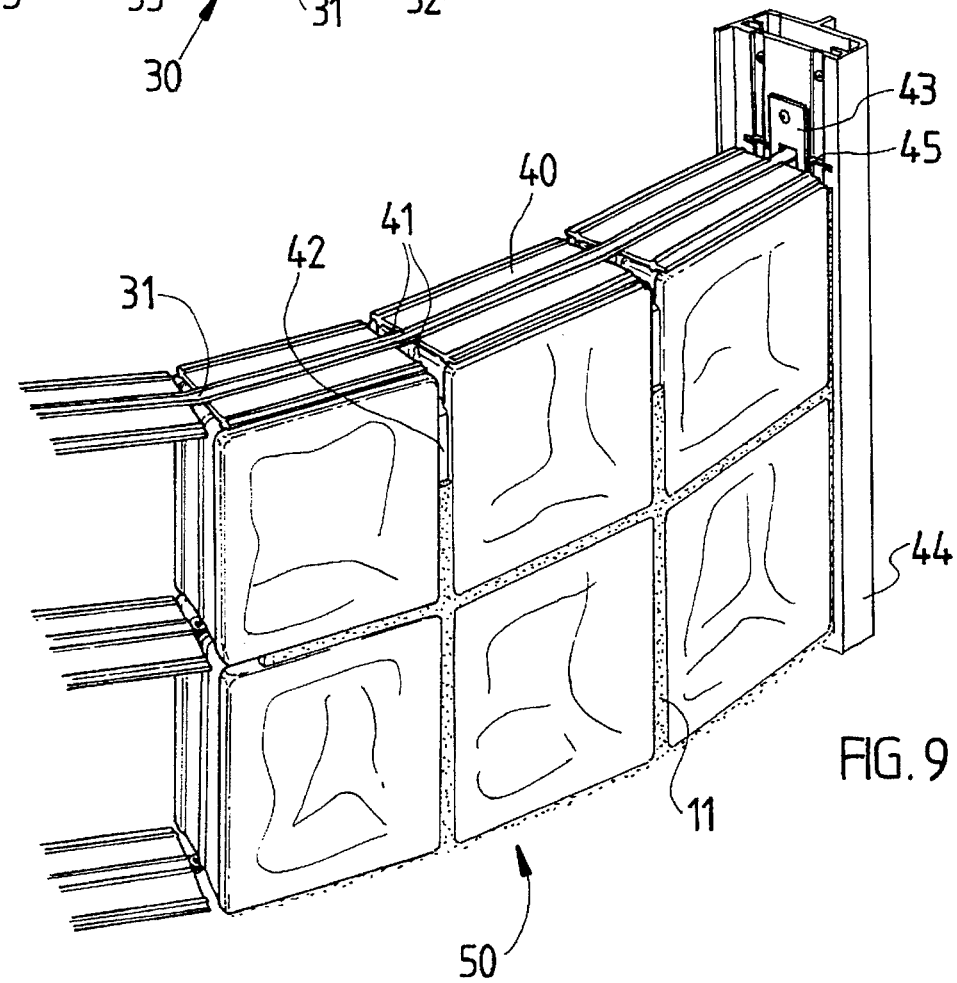

Referring to FIG. 9, there is illustrated a pictorial view of a partially completed construction of a curved glass brick wall using the separate strips of FIG. 8.

In FIG. 9, the separation strips 30 are in the form of segmented separation strips 40 so that the segmented separation strips 40 can be bent to follow a predetermined shape of the curve in the glass brick wall under construction. The segmented separation strips are formed by cutting or stamping out transverse outwardly extending or wedge shaped divisions from each side of the central portion 31 of the separation strips 30.

The transverse extending divisions are in the form of cut-out segments 41. The central portions 31 remaining between the cut-out segments 41 in the segmented separation strips 40 are then bent to follow the predetermined shape of the curve in the glass brick wall 50. The cut-out segments 41 are cut or stamped out in the segmented separation strips 40 so that the successive cut-out segments 41 are at intervals coinciding with the length of the glass bricks used in the construction of the curved glass brick wall 50.

The spaces between the glass bricks and the segmented separation strips 40 are filled with any suitable expanding setting filler and can take the form of a polyurethane filler 42 and/or grouting which is well known to a person skilled in the glass brick or building industries.

The segmented separation strips 40 are secured to the support frame 44 by a securing means in the form of horse shoe shaped brackets 43. The horse shoe shaped brackets 43 are located in the cut-out segments 41 inserted into the slots 45 in the support frame 3 so that the segmented separation strips 40 can remain in a fixed position in relation to the support frame 44.

Figure 10:
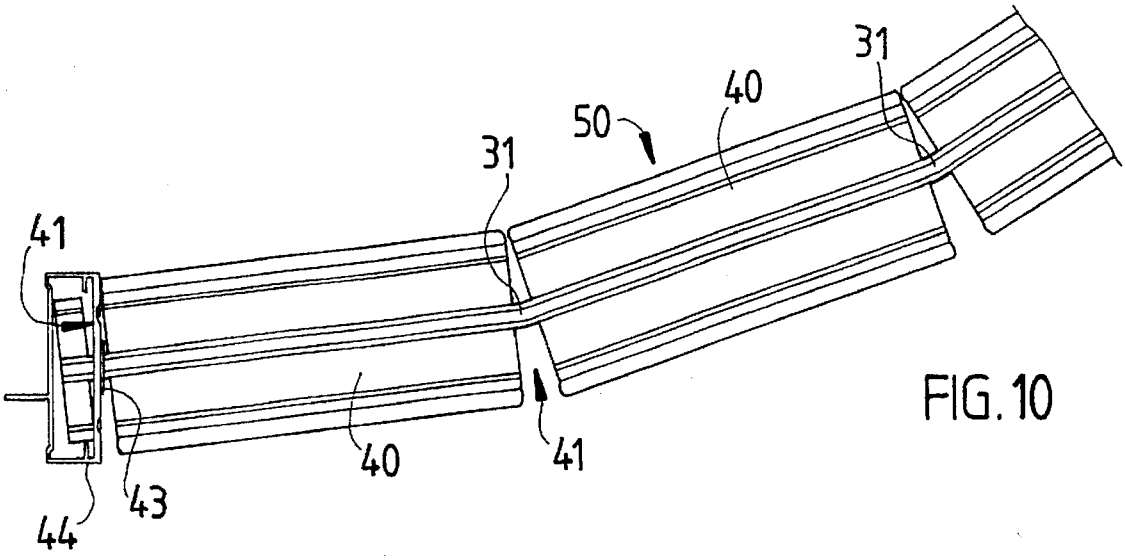

Referring to FIGS. 9 and 10, there is a plan view illustrating the segmented separation strip 40 inserted into and secured to the support frame 44 for the construction of the curved glass brick wall 50.

In FIGS. 9 and 10, the segmented separation strip 40 is secured to the support frame 44 using the horse shoe shaped bracket 43 located in the cut-out segment 41 inserted into slot 45 of the support frame 3.

The segmented separation strip 40 is bent at the central portions 31 between the successive cut-out segments 41 so that the strips 40 follow the predetermined shape of the curve in the glass brick wall 50.

FIG. 9 also illustrates the successive cut-out segments 41 coinciding with the lengths of each glass brick so that the glass bricks when positioned on the segmented separation strips 40 follow the predetermined shape of the curve bent into the segmented separation strips 40 to form the glass brick wall 50 of the present invention.

Figure 11:
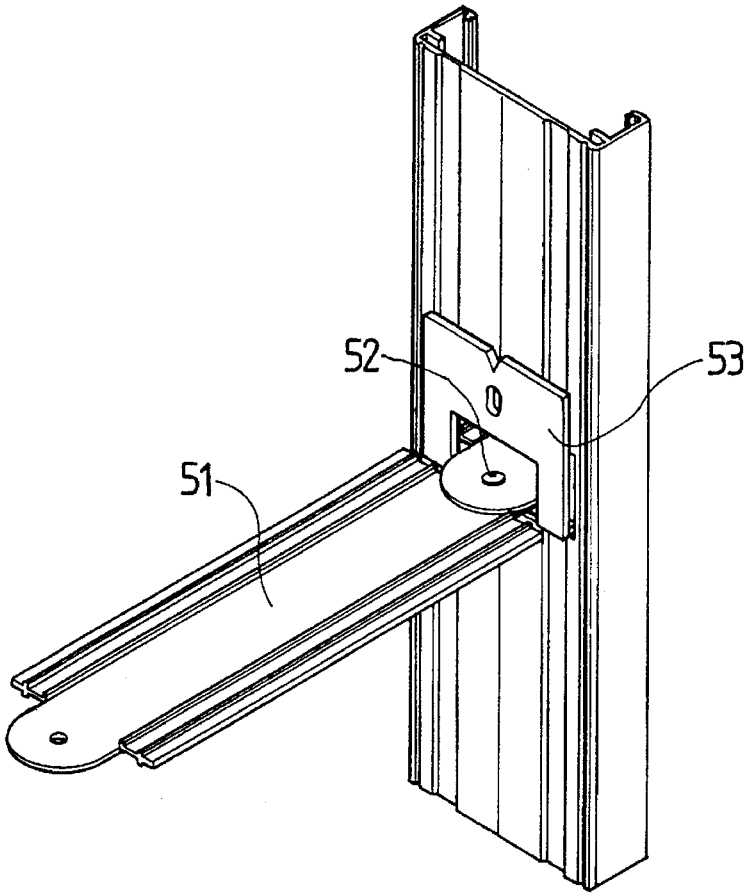
FIGS. 11 to 14 illustrate a further embodiment of the present invention.
Figure 12:
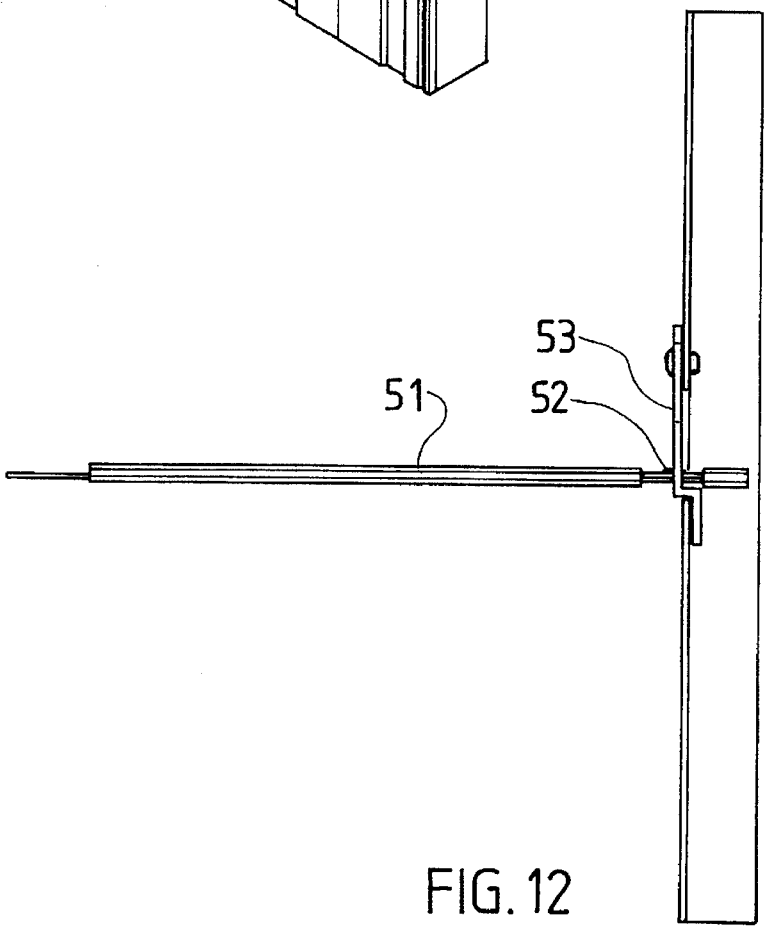
Figure 13:
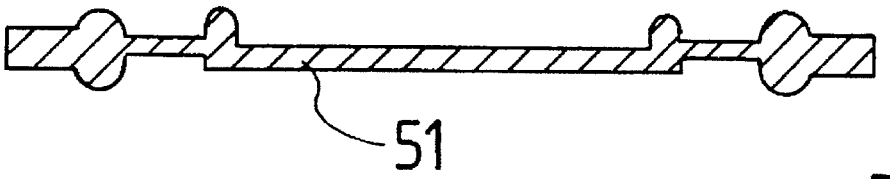

Referring to FIGS. 11 to 13 there is illustrated a further embodiment wherein in this case the separation strips 51 are hinged in the same fashion as in the embodiments of FIG. 2 but as can be seen the central portion of the separate strip where the hinge pin is located at 52 is much wider so that there is more metal to strengthen the connection.

Figure 14:
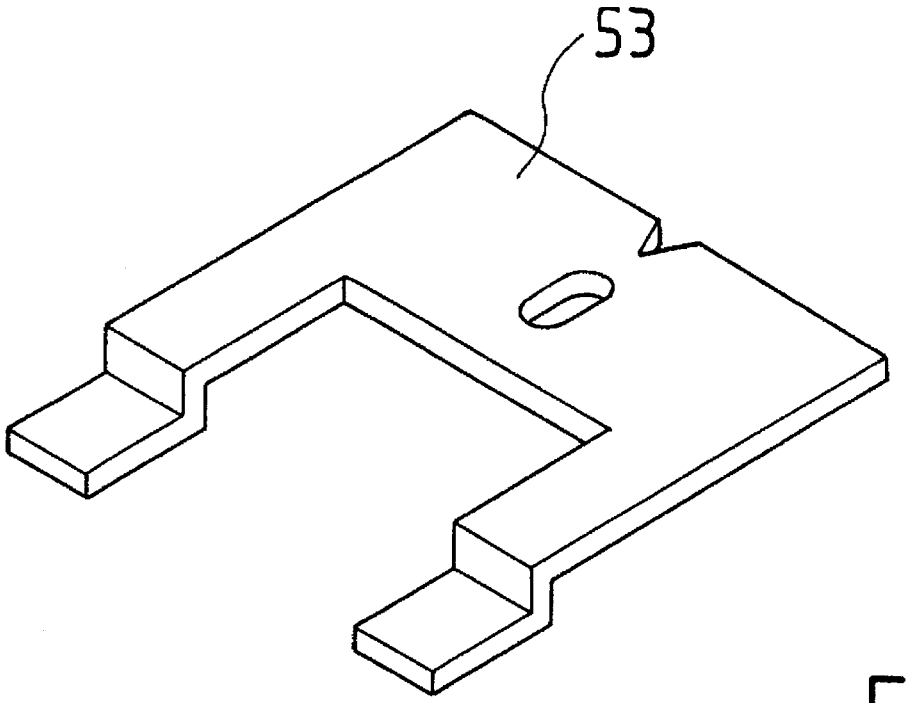

As can be seen in FIG. 13 the central portion is eccentric so that the sections are reversible so that they alternate along the wall to provide continuity and alignment. The horseshoe bracket 53 is illustrated in section in FIG. 12 showing it in place and also in FIG. 14.

Whilst the above has been given by way of illustrative example of the present invention, many variations and modifications thereto will be apparent to those skilled in the art without departing from the broad ambit and scope of the invention as set forth in the appended claims.

We claim:

1. A brick wall assembly comprising a plurality of bricks, the wall having horizontal separation strips extending between adjacent horizontal runs of bricks, each of the separation strips comprising adjacent substantially planar separation sections connected together end-to-end and moveable relative to one another so that adjacent sections can be moved to a pivoted position to support said bricks thereby forming a non-straight brick wall.

2. A brick wall assembly according to claim 1 wherein the sections are hinged together using hinge means.

3. A brick wall assembly according to claim 2 wherein the hinge means comprises overlaying projecting portions of adjacent sections coupled together by a hinge pin.

4. A brick wall assembly according to claim 3 wherein the projecting portions extend over a major portion of the width of said sections.

5. A brick wall assembly according to claim 1 or claim 2 wherein the bricks are located within a surrounding frame work including spaced vertical frame members, each vertical frame member having at least one horizontal slot to receive an end portion of said separation strip, the separation strip received in said slot having a transverse shoulder, and a separate bracket secured to the vertical frame member and engaging the shoulder on said separation strip, thereby securing said separation strip.

6. A brick wall assembly according to claim 1 or claim 2 further comprising brackets slidably receiving terminal end portions of the separation strips.

7. A brick wall assembly according to claim 1 wherein end portions of the separation strips, at end portions of the brick wall, are retained in slotted vertical frame members, and are secured therein by removable U-shaped brackets.

* * * * *